US006006702A

United States Patent [19]

Harth et al.

[11] Patent Number: 6,006,702

[45] Date of Patent: Dec. 28, 1999

[54] RETAINER SHIELD FOR SPLIT RING CASTINGS

[75] Inventors: George H. Harth, Wadsworth; James W. Flanagan, Uniontown, both of Ohio

[73] Assignee: The Babcock & Wilcox Company, New Orleans, La.

[21] Appl. No.: 09/096,045

[22] Filed: Jun. 11, 1998

[51] Int. Cl.[6] ..... F22B 37/06

[52] U.S. Cl. ..... 122/511; 248/901; 165/172

[58] Field of Search ..... 122/510, 511, 122/6 A; 165/162, 172, 178; 248/901

[56] References Cited

U.S. PATENT DOCUMENTS 3,828,735 8/1974 Graham et al. ..... 122/6 A
4,944,254 7/1990 Fournier et al. ..... 122/511
4,966,100 10/1990 Fournier et al. ..... 122/6 A
5,404,941 4/1995 Jacksits ..... 122/510
5,724,923 3/1998 Green ..... 122/511

*Primary Examiner*—Philip H. Leung
*Assistant Examiner*—Gregory A. Wilson
*Attorney, Agent, or Firm*—Daniel S. Kalka; Robert J. Edwards

[57] ABSTRACT

A retainer shield for a split ring retains boiler tubes aligned therein and dissipates heat from a front weld thereon. The retainer shield is preferably made from about 50% chromium and about 50% nickel and is welded to one end of the split ring to assist in holding the two halves of the split ring together. The retainer shield draws heat therefrom and dissipates it to prevent oxidation of the welds holding the two halves of the split ring together.

14 Claims, 3 Drawing Sheets

RETAINER SHIELD FOR SPLIT RING CASTINGS

BACKGROUND OF THE INVENTION

1. Field of the Invention

The present invention relates in general to split ring castings for retaining boiler tubes in a predetermined spaced configuration, and more particularly to retaining heat shields for same.

2. Description of the Related Art

Steam boilers used for heat generation utilize boiler tubes which are generally exposed and vertically hang downward from a top structure of the boiler and swing free in this position. These tubes are referred to in the industry as secondary super heater or reheat tubes, or heat recovery tubes for recovering lost heat. The boiler structure requires the boiler tubes to be aligned with respect to each other and held in a parallel position.

Known procedures for retaining these boiler tubes together in spaced parallel configuration utilize a split ring casting which is formed from two elongated parallel clamp halves forming a series of circular elements for clamping a series of these tubes in parallel between each circular element such that the tubes are then running perpendicular to the clamped halves.

These clamp halves each have a series of internal semi-circular openings which oppose each other when the two bar clamps are aligned in parallel to thereby in combination provide a series of split ring openings in each circular element when the bar clamps are clamped together to form the circular elements and to receive the tubes in parallel alignment in the internal semi-circular areas.

Alignment protrusions usually extend from each of the bar clamp halves toward the other between each semi circular recess. Opposing alignment openings are provided between each recess on the other clamp half to receive the respective alignment protrusions therethrough so that when the bars are clamped together in parallel engagement the protrusions extending from each bar half are guided through the opposed alignment openings in the other bar half so that when the clamp halves are fully engaged they form a series of rings for aligning and retaining the tubes therein in a parallel series.

The clamp halves of the split ring casting are clamped together, and the parallel clamp halves are then welded together to retain the tubes in their parallel alignment. Thereafter the clamp, if employed, on the bar clamps can be removed.

The described split ring castings work well in retaining the boiler tubes in proper relationship, but they have one difficulty. On boiler units having high gas temperatures, or in locations with high gas temperatures, the front portion of the split ring castings overheat and oxidize and the weld that joins the split ring castings together (located on the end of the split ring casting) fails. This oxidation and weld failure leads to the failure of the casting. Failure of the casting cause misalignment of the boiler tubes. Replacement of the split ring casting is expensive and very time consuming since the old casting must be removed, then the tubes realigned in the new casting, and the halves of the casting then clamped in place. The new casting is then welded together and the clamps removed if clamps are employed. Through bolt split ring castings can eliminate the requirement of the clamps.

Thus a split ring casting design is needed which does not suffer from failed weld joints when subjected to a high temperature environment or heat front.

SUMMARY OF THE INVENTION

The present invention is directed to solving the aforementioned high temperature problems associated with split ring castings as well as others by providing a retainer heat shield for a split ring casting to remedy the problems with such split ring castings discussed above.

The retainer shield is preferably made of a higher temperature alloy (such as about 50% Chrome and about 50% nickel alloy) than the material of the split ring casting. The retainer shield material is also chosen to resist oxidation. The retainer shield shields the weld located on the front of the split ring casting from heated gas flow. This helps keep the weld of the split ring casting from failing and keeps the casting from coming apart due to such failure.

In view of the foregoing it will be understood that one aspect of the present invention is to provide a heat shield for the weld joint found in split ring castings.

Another aspect of the present invention is to provide a highly thermal conductive element located on the split ring casting to shield the casting from the hot radiant heat of the boiler and to keep the weld joining the casting from overheating and failing.

Yet another aspect is to provide an easily replaceable retainer shield for split ring castings.

Still another aspect of the present invention is to provide a retainer shield that is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
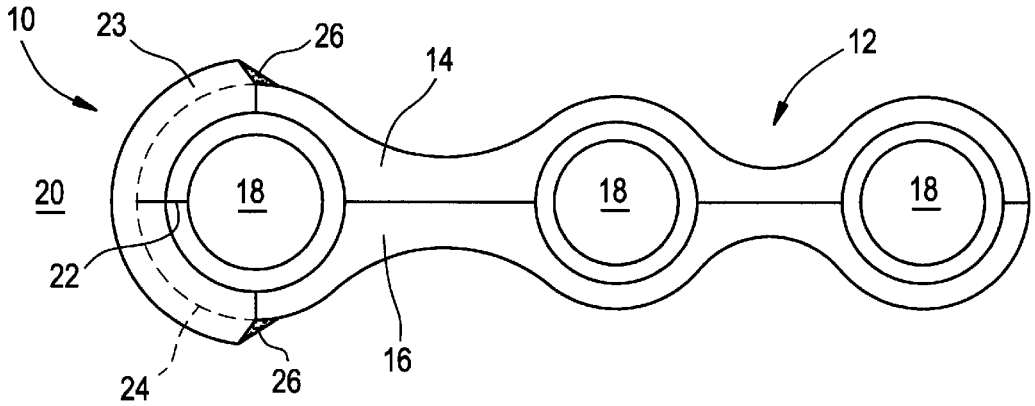
FIG. 1 is a top view of the split ring casting mounted on the boiler tubes with one embodiment of the retainer shield of the present invention located at the end facing a high temperature fluid flow.
Figure 2:
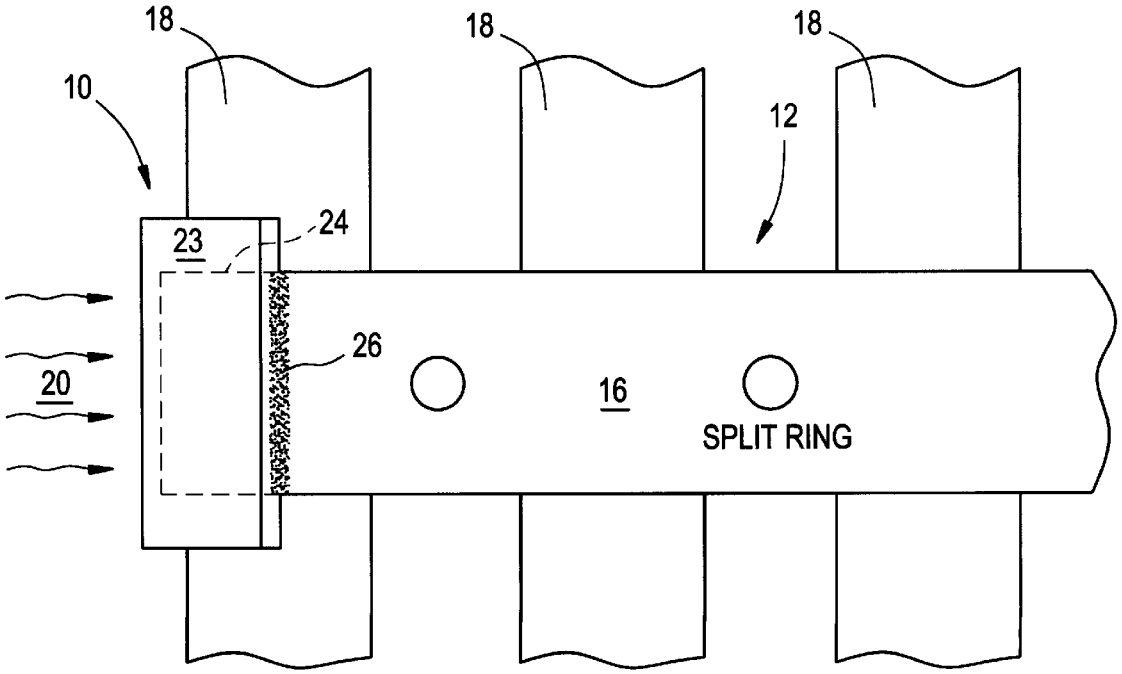
FIG. 2 is a side view of the embodiment of FIG. 1.

The present invention resides in a retainer heat shield assembly (10) which is easily mounted to a split ring assembly (12) by welding thereto.

As best seen in FIGS. 1–4, the split ring assembly (12) comprises two halves (14,16) which are aligned to hold boiler tubes (18) therebetween in a known manner. The halves (14,16) may be held together around tubes (18) by welding them together as is well known or even with fasteners such as bolts. As mentioned earlier, when the front portion of the split ring assembly faces a high temperature gas front (20), the entire casting (12) is in the high temperature environment, a weld (22) holding the halves (14,16) together can overheat and oxidize causing a failure of the weld (22) and as a result the assembly (12). The old assembly (12) must then be replaced with a new assembly (12) involving the removal of the old assembly and realignment of the tubes (18) within the new assembly (12) and the clamping and welding of same. To solve this problem a semi-circular retaining shield (23) conforming to the external dimensions of an end (24) of the casting assembly (10) is welded thereto at weld area (26). The shield (23) is preferably made from a high temperature alloy such as 50% chrome and 50% nickel, for example, making the retainer shield (22) not only resistant to oxidation but also able to shield the assembly (12) from radiant heat. This keeps the weld (22) intact and extends the life of the split ring assembly (12) thereby. The weld (26) further facilitates in keeping the halves (14,16) of the assembly (12) together. Also, should the retainer shield (22) be damaged or worn out it can be easily replaced by removing the weld (26) holding the shield (22) to the assembly (12), and replacing same without having to replace the entire split ring assembly (12) which would necessitate the realignment of the boiler tubes (18) therein.

Figure 3:
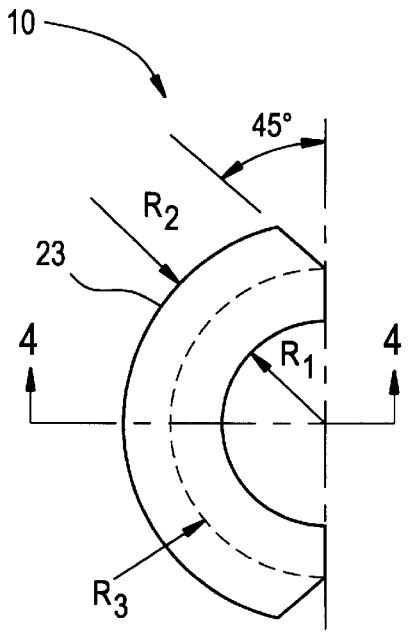
FIG. 3 is a top view of a retainer shield in accordance with the present invention.
Figure 4:
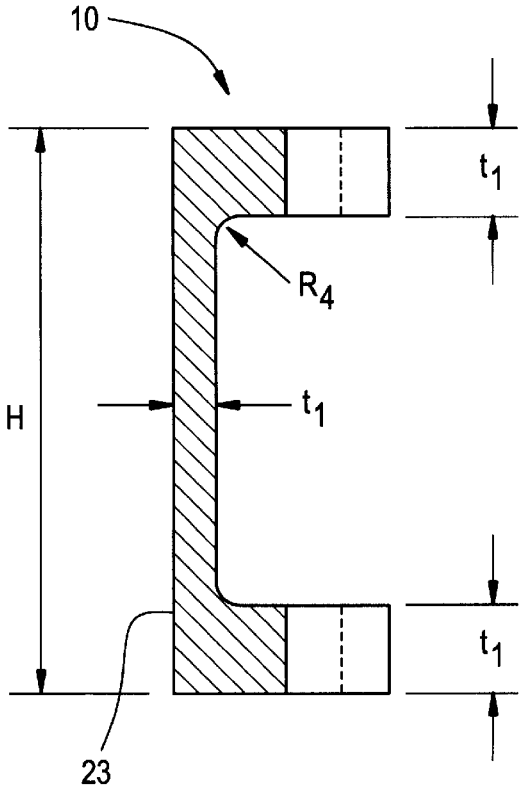
FIG. 4 is a side view of the embodiment shown in FIG. 3.

FIGS. 3 and 4 show typical dimensions for a retainer shield (22).

Figure 5:
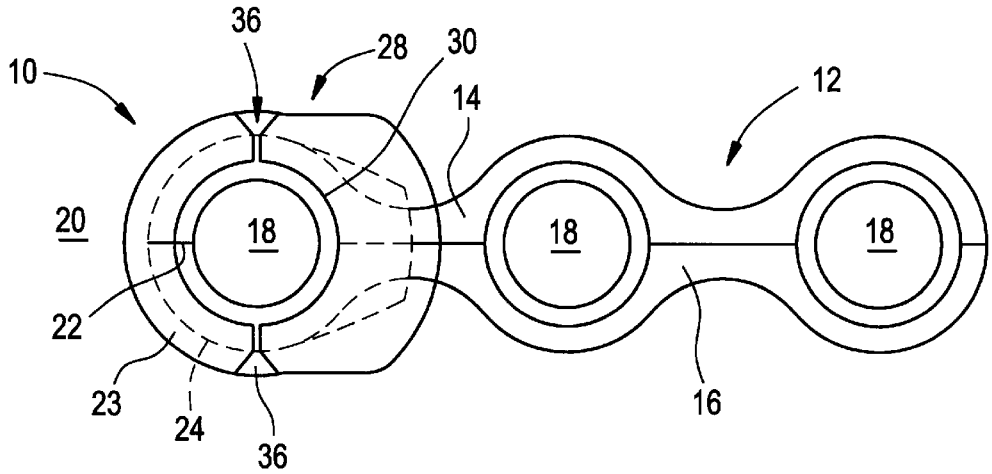
FIG. 5 is a top view of a second embodiment of the retainer shield of the present invention shown mounted on a split ring casting mounted on boiler tubes.
Figure 6:
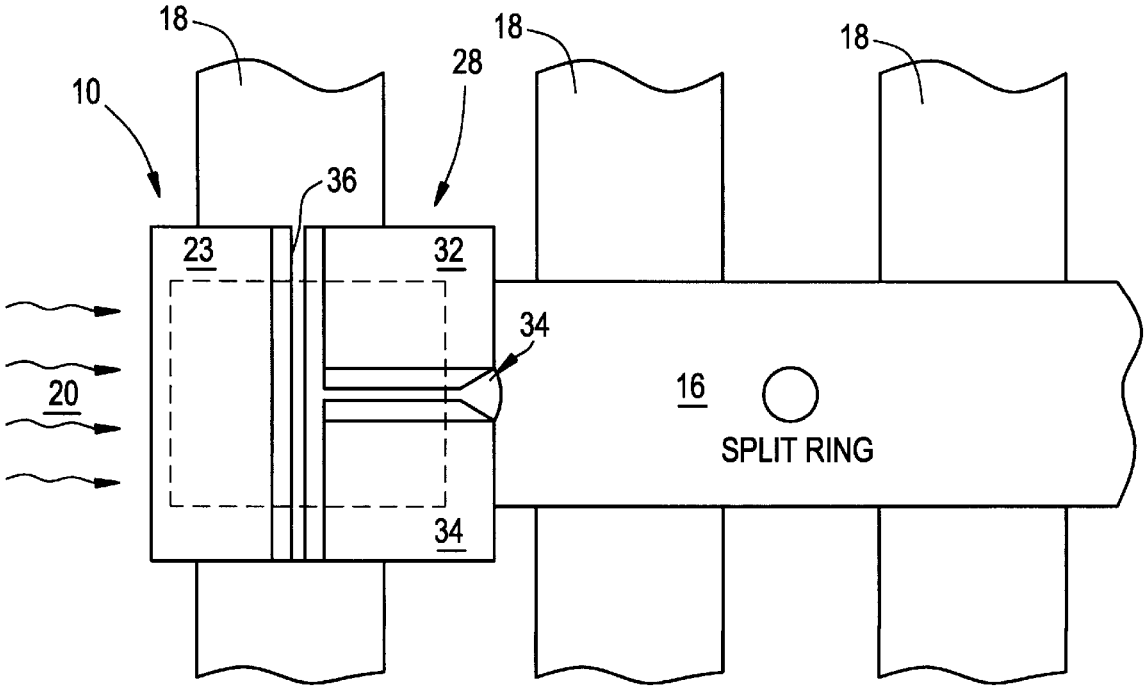
FIG. 6 is a side view of the embodiment shown in FIG. 5.

Turning to FIGS. 5 and 6, another embodiment of the retainer shield (23) includes an added back portion retainer assembly (28) to more effectively retain the halves (14, 16) of the assembly (12) by capturing a leading circular element (30) of the assembly (12) within a combined retainer made up of retainer (23) and back retainer assembly (28).

The back retainer assembly (28) is made up of a pair of elements (32, 34) preferably of the same composition as the retainer (23) and welded together at weld line (34) and to the front retainer shield (23) at weld line (36). Preferably, the weld line (36) is substantially vertical and weld line (34) substantially horizontal and approximately perpendicular to each other. The back retainer assembly (28) serves as a more positive retainer assembly.

While specific embodiments of the invention have been shown and described in detail to illustrate the application of the principles of the invention, it will be understood that the invention may be embodied otherwise without departing from such principles.

What is claimed is:

1. A shield assembly for a boiler tube split ring assembly, comprising:

a split ring assembly having two halves constructed to fit together for holding a series of boiler tubes therebetween in a fixed spaced relationship;

a shield conforming to the dimensions of an end of said split ring assembly and being permanently mounted to said one end of said split ring assembly to cover the end thereof and help retain the two halves of said split ring assembly together; and said shield further being made from a higher temperature alloy material than the material of said split ring assembly to allow heat to be dissipated from said assembly to said shield and away therefrom.

2. A shield assembly as set forth in claim 1, wherein said split ring assembly comprises a series of circular elements for holding a boiler tube in each element, and wherein said shield covers an entire front element of said assembly to retain said element therein.

3. A shield assembly as set forth in claim 2, wherein said shield includes a semi circular front portion covering the front of said first element and a rear portion covering a back portion of said first element with said front and rear portions being fixedly connected to each other.

4. A shield assembly as set forth in claim 3, wherein said front and rear portions of said shield are welded together.

5. A shield assembly as set forth in claim 1, wherein said shield is made from an alloy of chromium and nickel.

6. A shield assembly as set forth in claim 5, wherein said alloy is about 50% on a weight percent basis chromium.

7. A shield as set forth in claim 6, wherein said alloy is about 50% on a weight percent basis nickel.

8. A shield as set forth in claim 7, wherein said shield is mounted to said split ring assembly by welding thereto.

9. A retainer shield for a boiler tube split ring, comprising:

a boiler tube split ring made of a material having a predetermined temperature conductivity;

a retainer shield made of an alloy material having a higher conductivity than said split ring and being mountable to one end of said boiler tube split ring to cover an end thereof; and said retainer shield further includes a back portion which in combination is mountable on the split ring, said split ring having a series of circular elements for holding a boiler tube in each element with said retainer shield covering an entire front element of said split ring to retain said element therein.

10. A retainer shield as set forth in claim 9, wherein said retainer shield is semi-circular.

11. A retainer shield as set forth in claim 10, wherein said retainer shield is constructed of a nickel and chromium material.

12. A retainer shield as set forth in claim 10, wherein said retainer shield is constructed of about 50% on a weight percent basis nickel and about 50% on a weight percent basis chromium.

13. A shield assembly for a boiler tube split ring assembly, comprising:

a split ring assembly having two halves constructed to fit together for holding a series of boiler tubes therebetween in a fixed space relationship;

a shield mounted to one of said split ring assembly to cover the end thereof and help retain the two halves of said split ring assembly together;

said shield further being made from a higher temperature conducting material than said split ring assembly to allow heat to be dissipated from said assembly to said shield and away therefrom; and wherein said shield is made from an alloy of chromium and nickel.

14. A shield assembly for a boiler tube split ring assembly, comprising:

a split ring assembly having two halves constructed to fit together for holding a series of boiler tubes therebetween in a fixed spaced relationship;

a shield mounted to one end of said split ring assembly to cover the end thereof;

said shield further being a retainer for said split ring assembly and being made from a higher temperature conducting material than said split ring assembly to allow heat to be dissipated from said assembly to said shield and away therefrom;

said split ring assembly comprising a series of circular elements for holding a boiler tube in each element, and wherein said shield covers an entire front element of said assembly to retain said element therein; and wherein said shield includes a semi circular front portion covering the front of said first element and a rear portion covering a back portion of said first element with said front and rear portions of said shield being welded to each other.

* * * * *